United States Patent [19]

Lautenschlager

[11] Patent Number: 4,786,049

[45] Date of Patent: Nov. 22, 1988

[54] BICYCLE ERGOMETER

[75] Inventor: Peter Lautenschlager, Gonbach, Fed. Rep. of Germany

[73] Assignee: Keiper Dynavit GmbH & Co., Postfach, Fed. Rep. of Germany

[21] Appl. No.: 89,410

[22] Filed: Aug. 26, 1987

[30] Foreign Application Priority Data

Sep. 2, 1986 [DE] Fed. Rep. of Germany ..... 3629808

[51] Int. Cl.[4] ..... A63B 69/16

[52] U.S. Cl. ..... 272/73; 272/DIG. 6

[58] Field of Search ..... 272/73, DIG. 6

[56] References Cited

U.S. PATENT DOCUMENTS

| | | | |
|---|---|---|---|
| 4,112,928 | 9/1978 | Putsch | 272/73 |
| 4,542,897 | 9/1985 | Melton et al. | 272/73 |
| 4,678,182 | 7/1987 | Nakao et al. | 272/129 |
| 4,709,917 | 12/1987 | Yang | 272/73 |

FOREIGN PATENT DOCUMENTS

| | | |
|---|---|---|
| 3210899A1 | 10/1983 | Fed. Rep. of Germany . |
| 3404539A1 | 8/1985 | Fed. Rep. of Germany . |

*Primary Examiner*—Leo P. Picard

*Attorney, Agent, or Firm*—Dickstein, Shapiro & Morin

[57] ABSTRACT

A bicycle ergometer having selectable reference value programs for the braking moment, in accordance with which the braking moment of a controllable brake is automatically adjusted in dependence upon the number of pedal revolutions is disclosed, in which each reference value program for the braking moment is represented by a road in a landscrape depicted on a display. Light-emitting diodes are arranged along these roads with the distances from a starting point to the points marked by these light-emitting diodes corresponding to the number of necessary pedal revolutions. As the number of pedal revolutions defined by the diodes is reached, the appropriate light-emitting diode lights up. A multiple-gear-shift simulator with a manually actuatable gear selector simulates a multiple-gear transmission.

16 Claims, 4 Drawing Sheets

BICYCLE ERGOMETER

BACKGROUND OF THE INVENTION

The present invention relates to a bicycle ergometer having a programmable braking moment which can be automatically adjusted based upon the number of pedal revolutions over time.

In bicycle ergometers of this kind, it is known to change the moment of the brake in accordance with a reference value program. In a known embodiment, the user has the possibility of selecting one of several programs. To facilitate selection, these reference value programs are each illustrated in the form of a braking moment/time diagram on a display. Light-emitting diodes are arranged along the line curves illustrating these diagrams to indicate to the user which pair of values of the diagram is in effect at that time. However, such known devices do not provide their users with a ride that is close to a real-life bicycle ride.

SUMMARY AND OBJECTS OF THE INVENTION

In view of the foregoing, it should be apparent that there still exists a need in the art for a bicycle ergometer which encourages its user to exercise frequently and does so by providing a close to realistic bicycling experience.

It is, therefore, a primary object of the present invention to provide a bicycle ergometer which motivates people to use it more so than known bicycle ergometers. This object is achieved by a bicycle ergometer which simulates a bicycling experience in a realistic manner. More particularly, it is an object of this invention to provide a bicycle ergometer in which a selectable reference program is provided for controlling the braking moment.

Still more particularly, it is an object of the present invention to provide a display for a bicycle ergometer which depicts a landscape over which the bicycle user appears to be riding.

Another object of the present invention is to provide a bicycle ergometer with multiple-gear-shift simulation having a manually actuatable gear selector.

Briefly described, these and other objects of the present invention are accomplished by the inventive bicycle ergometer which is rendered very similar to a bicycle ride, both by the reference value programs for the braking moment which come very close to reality, and by the multiple-gear-shift simulator which enables the user to select the preferred gear at any time, as on a bicycle with a multiple-gear-shift. A pictorial representation in the form of roads in a landscape is provided so that the user is always being shown where he is on the selected road at any moment. As in reality, the drive force which the user must create is dependent upon the gradient of the road at that time, which can also be zero or negative, and upon a weight value corresponding to the sum of the user's weight and the weight of a bicycle.

In a preferred embodiment, selector switches, which may be identified by the number of the associated gear, are provided for gear selection. A light source can be used to indicate which gear is selected at that moment. These selector switches may be arranged in a front plate comprising the display and enabling good operability and good visual checking.

Also in a preferred embodiment, the routes set by the selectable roads may have different lengths and/or different maximum gradients. It is expedient to provide manually actuatable selector switches for selecting the routes. To come even closer to reality than in the case where only a certain number of routes can be selected, additional manually actuatable switches may be provided to enable alteration of the route at each crossroad, junction or fork of the road. Reversal of the direction of travel on the road selected at that moment can be simulated by means of an additional switch.

In a preferred embodiment, light-emitting diodes are arranged along the selected route and light up in a rapid sequence below a lower limit of the rotational speed of the pedal and also when the pedal is not being turned. This gives the user an opportunity to acquaint himself with the selected route. In the preferred embodiment, the rotational speed of the pedal need only be raised above the lower limit value in order to initiate a start time from the fixed starting point. Then, the only light-emitting diode which remains illuminated is that one which corresponds to the stretch of the simulated route where the user is at that time.

In a preferred embodiment, an additional alphanumeric display may be integrated into the display containing the landscape. This alphanumeric display may continuously indicate the instant values of a number of important quantities, for example, the user's performance in watts at that moment, the rotational speed of the pedal, the user's heart rate, the elapsed time since the start of the simulated ride, the distance covered so fat, the present speed, the calories consumed by the user since the start of the ride and the upward or downward gradient of the road at that time.

If the user is to be given the possibility of interrupting the simulated ride at any point on the selected route, a long-term memory can be provided to store all of the data for continuation of the simulated ride at any time after the point at which the ride was interrupted.

The data and output on the alphanumeric display are determined by a computer which is also responsible for activating the light-emitting diodes and which processes commands entered by way of the switches. Therefore, there is no difficulty in making the braking moment adjustment dependent upon a weight value which can be entered by the user on a keyboard instead of upon an assumed weight value for the user and the bicycle. Since the gradient values for all selectable routes are stored in a memory, they can easily be requested by the computer. In a preferred embodiment not just one single reference value for the braking moment is stored for each point on all selectable routes, but also all of those reference values which are valid when the selected gear is taken into consideration. In this way, the reference values for the braking moment are made available more rapidly than if they had to be calculated based upon the selected gear. Despite the increased expenditure for the memory, the thus gained reduction in the expenditure for the computer results in a reduction of costs.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
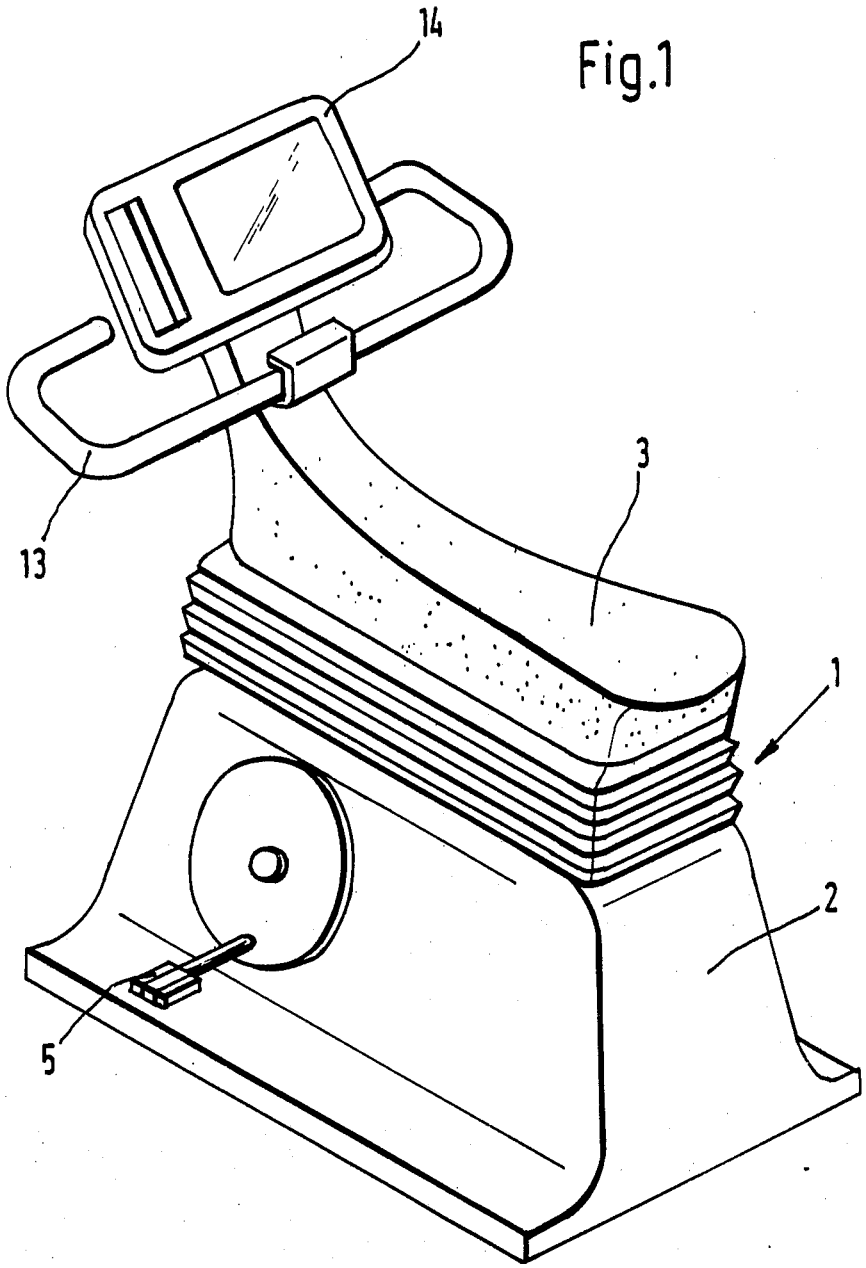
FIG. 1 is a pictorial drawing of the bicycle ergometer of the present invention.
Figure 2:
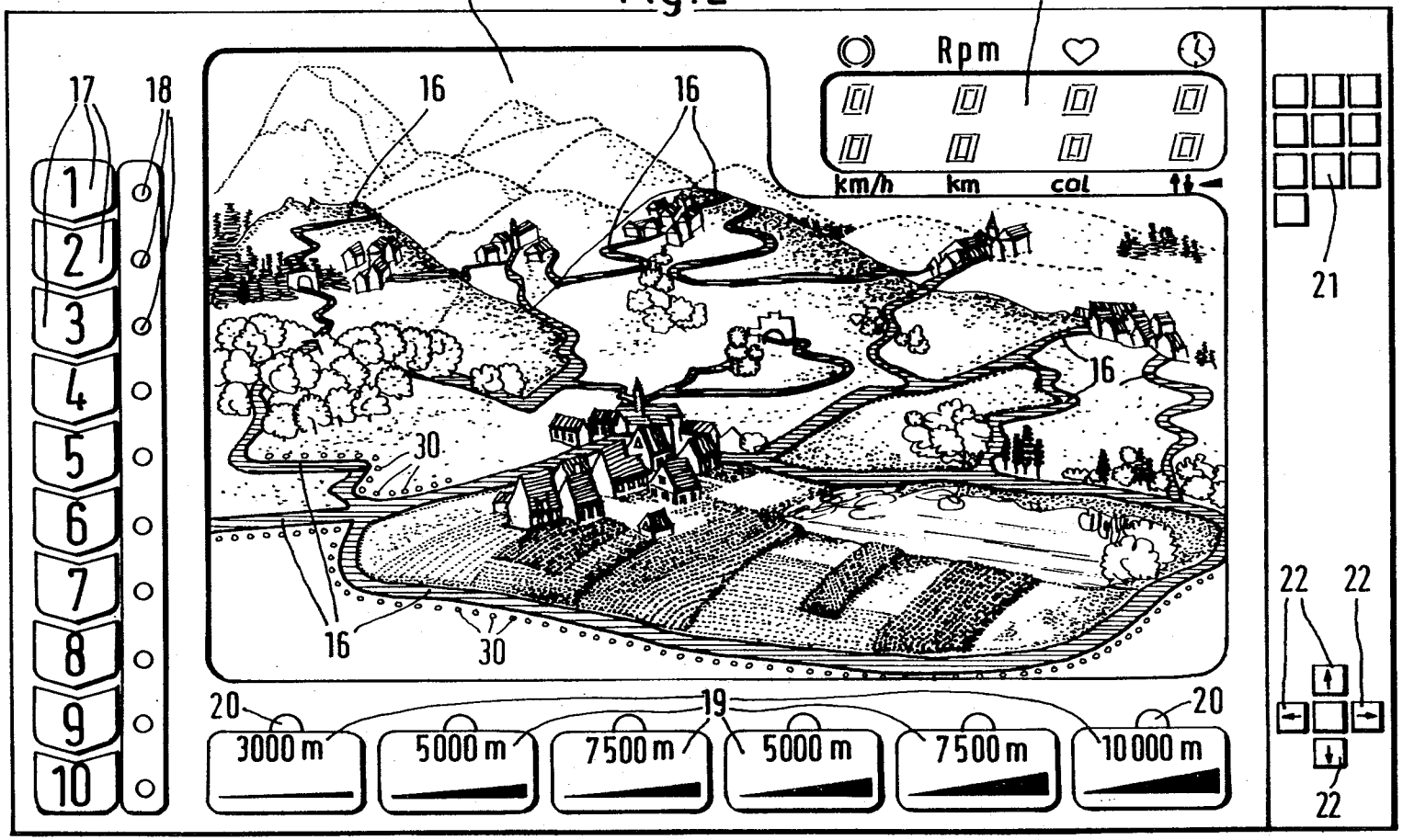
FIG. 2 is a pictorial drawing of the display and control panel of the bicycle ergometer of the present invention, on which a sample landscape display is shown.

Referring now to the drawings, there is shown in FIGS. 1 and 2, a bicycle ergometer 1. The bicycle ergometer 1 includes a housing 2 which carries a vertically adjustable bench 3, an eddy-current brake 4 which is connected to a pedal 5 by means of gearing which is not illustrated. The rotational speed of the eddy-current brake 4 is detected in digital form by a rotational speed sensor 6. The braking moment of the eddy-current brake 4 may be adjusted with the aid of the exciting current whose actual value is measured and fed to a current control unit 7. This current control unit 7 controls an electronically operated regulator 8 which is located in the line leading from a power source 9 to the eddy-current brake 4.

A computer 10 determines, for current control unit 7, the reference value of the exciting current corresponding to the reference value for the braking moment. These reference values are interrogated from a memory 11 by the computer 10. As is apparent from FIG. 3, the computer 10 is also connected to a long-term memory 12 which contains that date which, in the event of interruption of the simulated ride, is required for continuation of the ride at any time after the point where the ride was interrupted.

As is apparent from FIG. 1, the part of the bicycle ergometer 1 forming the bench 3 comprises at one end an upwardly inclined support to which a handle 13, corresponding to the handlebar of a bicycle, is adjustably attached. Also connected to this support is a casing 14 whose front plate is directed towards the user's face. As shown in FIG. 1, this front plate contains a display 15 showing a landscape with both flat and hilly regions and roads 16 going through the landscape. In the region of these roads 16, the display 15 is transparent because light-emitting diodes 30 are arranged along the roads 16 on the rear side of the display 15, and more particularly, at spacings which each correspond to a stretch of for example, 100 meters in the natural environment.

Arranged along the left edge of the display 15 is a row of ten push-button switches 17 enabling gear selection as on a bicycle with a 10 gear-shift system. Hence, the push-button switches 17 bear the numbers 1 to 10. Arranged beside each push-button switch 17 is a light-emitting diode 18 which is illuminated as long as the associated switch is activated to show the user which gear he is using at the time.

Arranged along the lower edge of the display 15 are several, six in the preferred embodiment, route selector switches 19 which are also in the form of push-button switches. They indicate the length of the associated route and the maximum gradient of the route. Associated with each route selector switch 19 is a light-emitting diode 20 which is illuminated as long as the associated switch is activated.

Provision may also be made for specifying a total weight corresponding to the user's weight plus the weight of a bicycle, in order to determine the reference value for the braking moment. For that purpose a digital keyboard 21 may be arranged beside the right-hand edge of the display 15 in the front plate of the casing 14 for entry of the numerical value of the weight by the user. In the preferred embodiment, four manually actuatable switches 22 bearing symbols, for example, arrows pointing forwardly, rearwardly, to the left and to the right, are also included in this edge zone. These switches 22 enable the user to depart from a preselected route at a crossroads, a junction or a fork of the road and to change over to another route.

A reversal of the direction of travel can be simulated by actuating the switch 22 bearing the symbol pointing rearwardly.

In the preferred embodiment, an alphanumeric two-line display 23 is arranged in the top right-hand corner region of the display 15. The instant values of the user's performance in watts, the rotational speed of the foot pedal 5 in revolutions per minute, the heart bar frequency and the time in minutes which has elapse since the start of a simulated ride may be continuously indicated in the top line. The bottom line may constantly indicate the instant value of the speed in kilometers per hour, the kilometers covered since the start of the ride and the upward or downward road gradient, in percent.

The switches 17, 19, and 22, the associated light-emitting diodes, the keyboard 21 and the alphanumeric display 23 could, of course, be arranged differently, as is is merely a question of their being easily accessible t the user of the bicycle ergometer.

Figure 3:
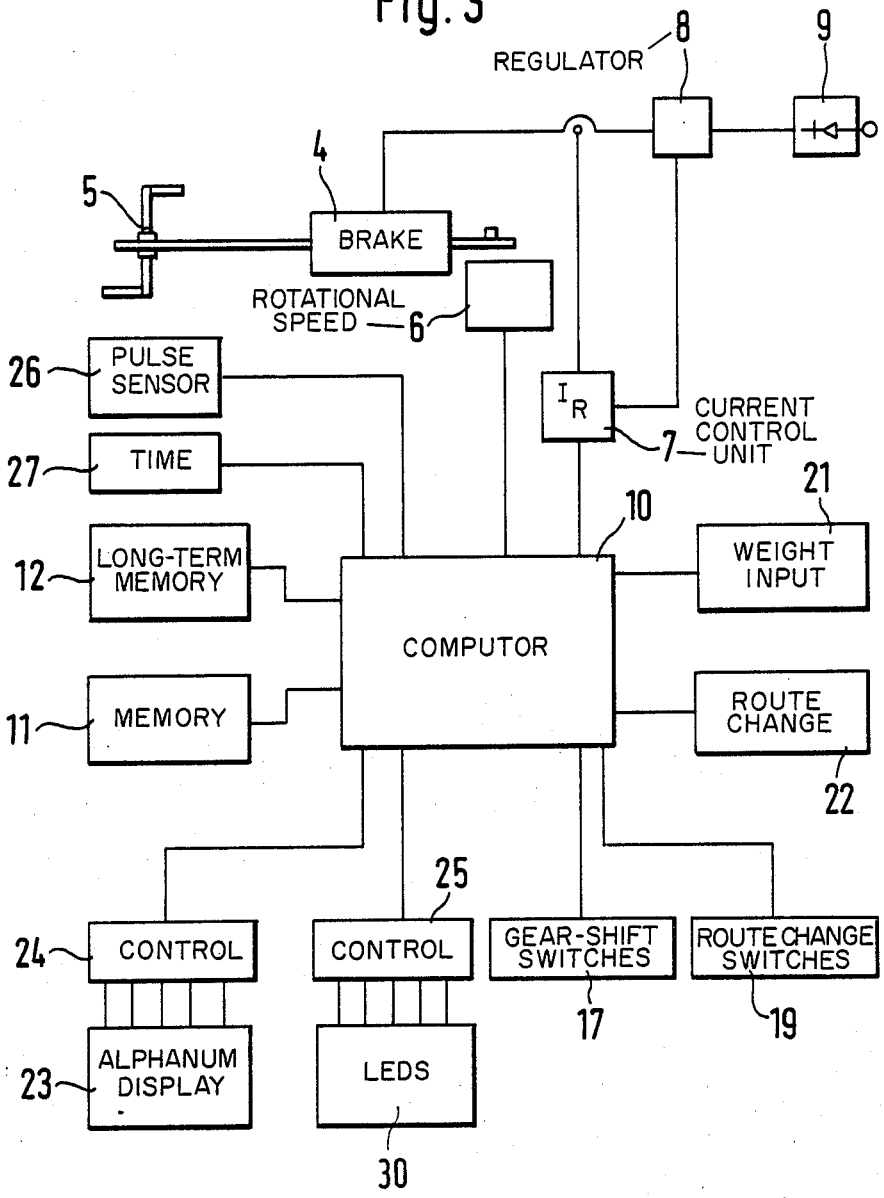
FIG. 3 is a schematic block diagram of the circuitry of the bicycle ergometer of the present invention.

As is apparent from FIG. 3, both a control system 24 for activating the alphanumeric display 23 and a control system 25 for driving all of the light-emitting diodes are connected to the computer 10. Also connected to the computer 10 are the push-button switches 17 constituting the gear shift system, the route selector switches 19, the switches 22 for changing the route and the keyboard 21 for entry of the user's weight. A timer 27 and the rotational speed sensor 6 are likewise connected to the computer 10. Finally, a pulse sensor 26, for example, in the form of a light barrier which can be placed against the user's ear, is connectable to the computer 10 for determining the user's pulse frequency.

In order to use the bicycle ergometer 1, the user first adjusts the bench 3 to the correct height and the handle 13 to the correct position and then switches on the power supply which, in the preferred embodiment, is connected to a source of AC power. A route is then selected by the user by actuating one of the route selector switches 19, which brings about an initialization. The computer 10 first initiates a rapid driving of the light-emitting diodes 20 arranged along the selected route thereby causing these light-emitting diodes 30 to light up in a rapid sequence and make the road corresponding to the selected route discernible. The computer 10 also selects the mode of operation which corresponds to a ride with the lowest gear, i.e., the first gear. At this time or during the simulated ride, the user can, however, select any other gear.

Once the rotational speed of the foot pedal 5 exceeds the lower limit of, for example, 20 revolutions per minute, the computer 10 receives the command to start the program associated with the selected route and the selected gear and to start the continuous calculation of and output the values which are provided on the alphanumeric display 23. The computer 10 then continuously specifies to the current control unit 7 a reference value which pertains to the selected gear and to the point on the selected route of the simulated ride where the user is at that time. The distance covered since the start of the simulated ride is determined by the computer 10 on the basis of the number of pulses generated by the rotational speed sensor 6 which is a measure of the number of revolutions of the pedal 5. The distance covered is also determined on the basis of the selected gear for which those distance values corresponding to one revolution of pedal 5 are stored in memory 11.

At the end of the selected route of the simulated ride, which, in the preferred embodiment, coincides with the starting point, all of the light-emitting diodes 30 along the covered route start to blink. If the user continues the simulated ride, i.e., if he continues to actuate the pedal 5 at a rotational speed above the lower limit, the blinking then stops and the same route is followed again unless the user selects a different route.

In the preferred embodiment, if the ride is repeated on the same route, only the calories which have been consumed are added up. The previous ride is not taken into consideration in all other values indicated on the alphanumeric display 23. A computer program could, of course, also be selected so that the previously covered distance is also taken into consideration in the indication of the number of kilometers.

Figure 4:
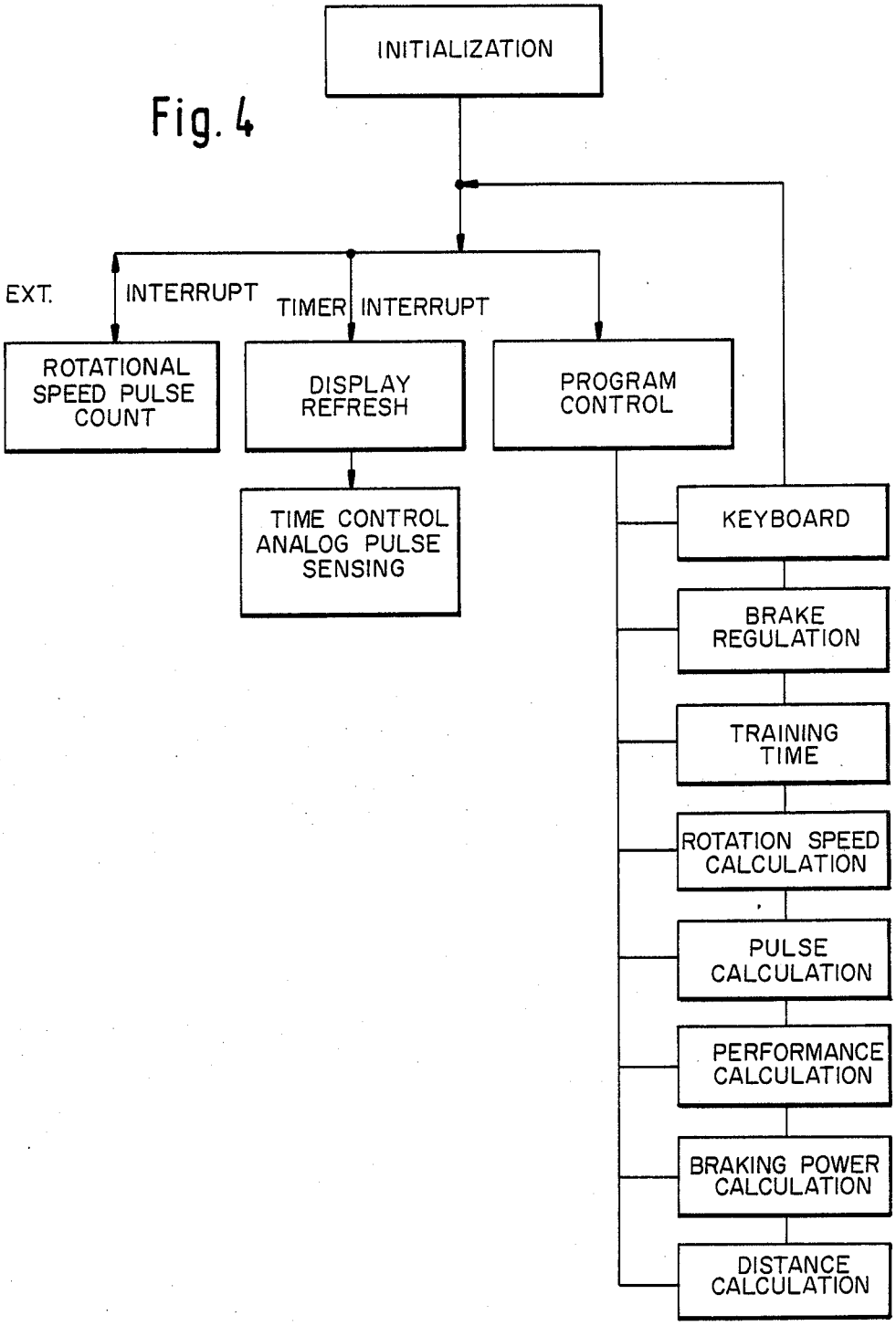
FIG. 4 is a schematic flow chart representing the program functions of the bicycle ergometer of the present invention.

FIG. 4 sets forth the software organization of the invention, In particular, the braking functions are already set forth with respect to the hardware described above with respect to FIG. 3. The remaining software functions, i.e., riding time, speed, pulse, performance and distance are previously known and do not constitute the subject matter of the present invention.

As is apparent to one skilled in the art, the braking moment, which has to be overcome by the rider, primarily depends upon the transmission ratio, i.e. the selected gear, of the gradient of the road and of the weight (rider+bicycle) to be moved along the instant gradient. In addition thereto, some kinds of losses should be taken into consideration, such as losses of the transmission due to friction or air resistance to the rider. The transmission losses can be taken into account as a fixed transmission efficiency (%) whereas the air resistance preferably is taken as a variable value in a functional relationship with the instant speed of travel. The losses create a braking moment even when riding along a horizontal path (a road having no gradient). The calculation of the value of the momentum on the basis of the above parameters is a simple matter of arithmetic.

Although only a preferred embodiment is specifically illustrated and described herein, it will be appreciated that many modifications and variations of the present invention are possible in light of the above teachings and within the view of the appended claims without departing from the spirit and intended scope of the invention.

What is claimed is:

1. A bicycle ergometer, comprising:

computer means for controlling the braking force of a controllable brake which controllabe brake may be automatically adjusted in response to the number of pedal revolutions of said bicycle, said computer means being operative with at least one selected reference value program of the product of a weight value of the user's weight and the gradient of the road;

display means arranged within the field of view of the user of said bicycle ergometer, said display means comprising a representation in the form of at least one line curve of each selected reference value program for the braking force, the course of each such line curve serving to make the size of the reference value of the braking force discernible;

said display means comprising light-emitting diodes arranged along each line curve such that the length of the line curve from its starting point to the points marked by said light-emitting diodes corresponds to predetermined values of the number of pedal revolutions, such associated light emitting diodes being illuminated when said predetermined values are reached; and each of said line curves being constituted by a road in a landscape depicted on said display means.

2. The bicycle ergometer of claim 1, further including means for simulating a multiple-gear-shift having a manually actuatable gear selector and said braking force is adjusted in accordance therewith.

3. The bicycle ergometer of claim 2, wherein a selector switch is associated with each selected gear.

4. The bicycle ergometer of claim 3, wherein said selector switches of said gear selector are arranged alongside each other in a front plate comprising said display means, and a light-emitting diode is associated with each selector switch to indicate that it is activated.

5. The bicycle ergometer of claim 1, wherein a plurality of selected routes are determined by the roads depicted on said display means and each of the selected routes have different lengths and different maximum gradients.

6. The bicycle ergometer of claim 5, further comprising a manually actuatable selector switch associated with each selected route.

7. The bicycle ergometer of claim 6, further comprising manually actuatable switches provided to accomplish a changeover form one selected route to others at crossroads, junctions or forks of the road and/or for a simulated reversal of the direction of travel.

8. The bicycle ergometer of claim 5, wherein below a predetermined limit of the rotational speed of the pedal, the light-emitting diodes arranged along the selected route light up for a short time with a specified repetition frequency.

9. The bicycle ergometer of claim 1, further comprising an additional alphanumeric display means for selectably displaying at least one of the instantaneous value of the user's performance, the rotational speed of the pedal, the pulse frequency of the user, the elapsed time since the start of the simulated ride, the simulated travel speed, the distance covered, the calories consumed by the user since the start of the ride and the upward or downward gradient of the road.

10. The bicycle ergometer of claim 5, further comprising a long-term memory means for storing data pertaining to any points on the selected routes when said ergometer is switched off before the destination of the selected route is reached.

11. The bicycle ergometer of claim 5, wherein each selectable route is identified by a sequence of data which is associated with the individual points on this route and are stored in memory means.

12. The bicycle ergometer of claim 11, wherein the different data pertaining to individually selected gears is stored for each point on each selected route.

13. The bicycle ergometer of claim 3, wherein said computer continuously determines the instantaneously valid reference value of the braking force on the basis of the data stored in said memory means.

14. The bicycle ergometer of claim 3, wherein said computer calculates the distance covered and the instantaneous speed, in accordance with the selected gear, as well as the number of calories consumed, in accordance with the user's performance.

15. The bicycle ergometer of claim 1, wherein the selected reference value program further includes the weight of the bicycle.

16. The bicycle ergometer of claim 15 wherein said weight value is entered by the user by means of keyboard means.

* * * * *